US011768447B2

(12) United States Patent
Hirano et al.

(10) Patent No.: US 11,768,447 B2
(45) Date of Patent: Sep. 26, 2023

(54) TONER FOR DEVELOPING AN ELECTROSTATIC CHARGE IMAGE AND AN IMAGE FORMING METHOD

(71) Applicant: Konica Minolta, Inc., Tokyo (JP)

(72) Inventors: Shiro Hirano, Tokyo (JP); Takanari Kayamori, Kanagawa (JP); Yuya Kubo, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 140 days.

(21) Appl. No.: 17/371,238

(22) Filed: Jul. 9, 2021

(65) Prior Publication Data

US 2022/0011687 A1 Jan. 13, 2022

(30) Foreign Application Priority Data

Jul. 13, 2020 (JP) ..... 2020-120023

(51) Int. Cl.

| | |
|---|---|
| ***G03G 9/09*** | (2006.01) |
| ***G03G 9/087*** | (2006.01) |
| ***G03G 9/097*** | (2006.01) |
| ***G03G 9/08*** | (2006.01) |

(52) U.S. Cl.

CPC ..... *G03G 9/0906* (2013.01); *G03G 9/0821* (2013.01); *G03G 9/08711* (2013.01); *G03G 9/08755* (2013.01); *G03G 9/0904* (2013.01); *G03G 9/0926* (2013.01); *G03G 9/09708* (2013.01)

(58) Field of Classification Search

CPC ..... G03G 9/08755; G03G 9/0904; G03G 9/0918; G03G 9/0926

See application file for complete search history.

(56) References Cited

U.S. PATENT DOCUMENTS

2012/0082926 A1* 4/2012 Suzuki ..... G03G 9/0924 430/105
2014/0134529 A1* 5/2014 Yamada ..... G03G 9/0922 430/107.1

FOREIGN PATENT DOCUMENTS

JP 105-297635 A 11/1993
JP 2009-079096 A 4/2009

* cited by examiner

*Primary Examiner* — Peter L Vajda
(74) *Attorney, Agent, or Firm* — LUCAS & MERCANTI, LLP

(57) ABSTRACT

The toner for developing an electrostatic charge image of the present invention contains a toner base particle comprising a binder resin and at least two kinds of organic pigments, and alumina as an external additive. The at least two kinds of organic pigments comprises: a pigment P1 having an absorption maximum wavelength λmax (nm) of greater than 400 nm and less than 600 nm when dispersed in methyl ethyl ketone; and a pigment P2 having an absorption maximum wavelength λ max (nm) of 600 nm or more and 700 nm or less when dispersed in methyl ethyl ketone.

10 Claims, 1 Drawing Sheet

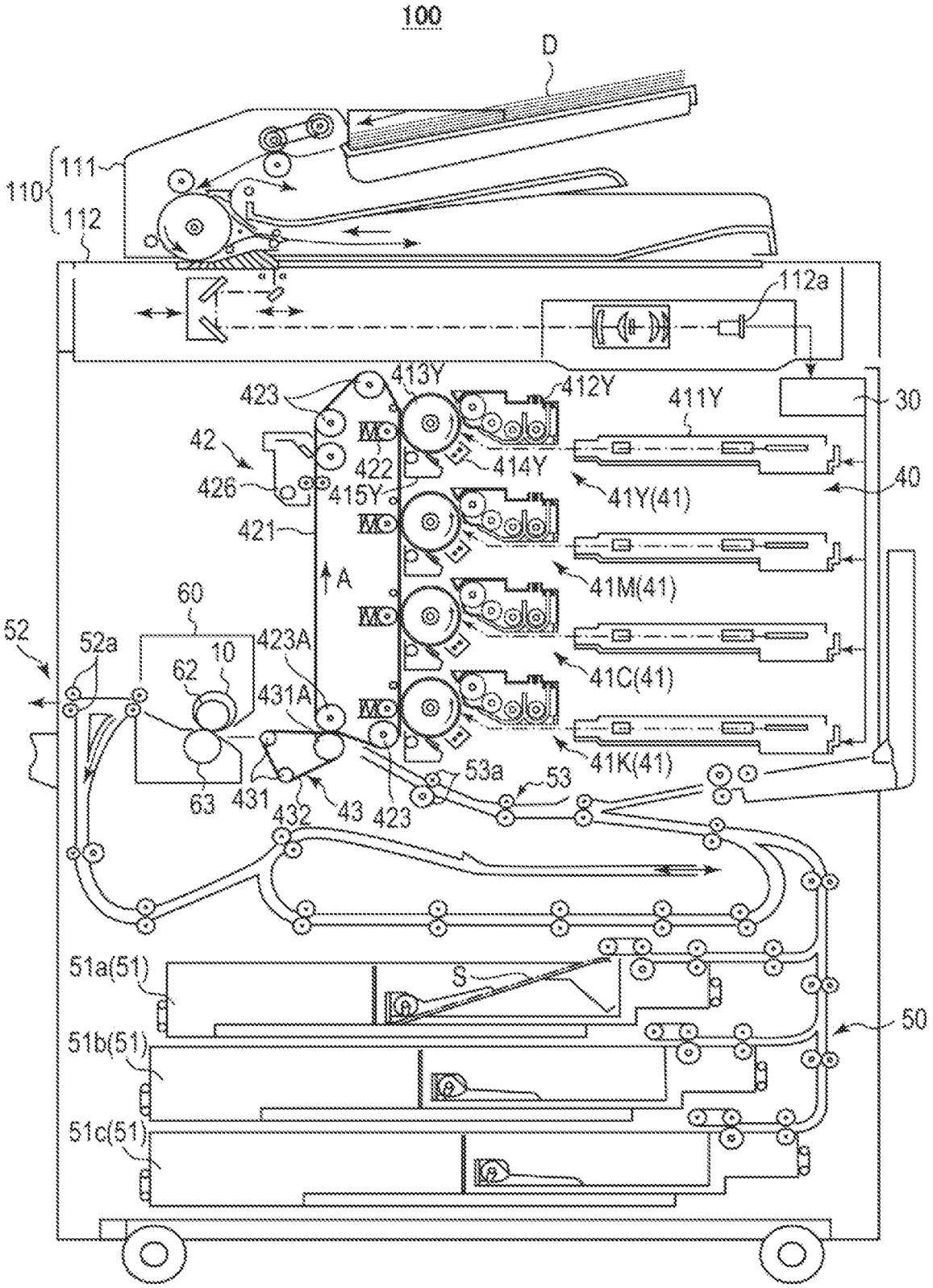
100
D
110
111
112
112a
30
423
413Y
412Y
411Y
42
422
414Y
426
415Y
41Y(41)
40
421
A
41M(41)
60
52
52a
10
423A
62
431A
41C(41)
41K(41)
53a
53
63
431
432
43
423
51a(51)
S
50
51b(51)
51c(51)

TONER FOR DEVELOPING AN ELECTROSTATIC CHARGE IMAGE AND AN IMAGE FORMING METHOD

CROSS REFERENCE TO RELATED APPLICATIONS

The entire disclosure of Japanese Patent Application No. 2020-120023 filed on Jul. 13, 2020, is incorporated herein by reference in its entirety.

BACKGROUND

Technological Field

The present invention relates to a toner for developing an electrostatic charge image and an image forming method.

Description of Related Art

Toners are known in which organic pigments of different color tones are internally added into one toner base particle so that light in a wide wavelength range can be absorbed. Typically, the above type of toner absorbs electromagnetic waves in the visible light region well, but the amount of absorption of electromagnetic waves in the near infrared region is small. Thus, the above toner can be used for forming an image which is black in appearance but is observed as transparent when a detector having sensitivity only to near infrared rays is used. With such characteristics, the above toner can be used for forming an image to which a region having transparency to near infrared rays is partially imparted. The imparted near-infrared transparent region can be used as a hidden information which cannot be recognized by a person's eye (for example, JP-A-5-297635 and JP-A-2009-790%).

Since carbon black absorbs electromagnetic waves in the near infrared region, the above transparency to the near infrared rays cannot be achieved by a toner containing carbon black as a pigment (Japanese Patent Application Laid-Open No. 2009-79096).

SUMMARY

As described above, a toner in which a plurality of kinds of organic pigments are internally added into one toner base particle is known. However, according to the findings of the present inventors, such a toner has insufficient chargeability or insufficient blackness for concealing the formed image.

In view of the above problems, it is an object of the present invention to provide a toner in which while a plurality of kinds of organic pigments are internally added into one toner base particle, the toner has a higher chargeability and sufficient concealability of a formed image.

In order to realize the above object, a toner for developing an electrostatic charge image reflecting one aspect of the present invention has toner base particles and an external additive. The toner base particles include a binder resin and at least two kinds of organic pigments, and the external additive includes alumina.

The at least two kinds of organic pigments comprises: a pigment P1 having an absorption maximum wavelength λmax (nm) of greater than 400 nm and less than 600 nm when dispersed in methyl ethyl ketone; and a pigment P2 having an absorption maximum wavelength λ max (nm) of 600 nm or more and 700 nm or less when dispersed in methyl ethyl ketone.

BRIEF DESCRIPTION OF DRAWINGS

The advantageous and features provided by one or mom embodiments of the invention will become more fully understood from the detailed description given hereinbelow and the appended drawing which are given by way of illustration only, and thus are not intended as a definition of the limits of the present invention:

FIG. 1 is a schematic configuration diagram illustrating an example of an image forming apparatus relating to the present embodiment;

DETAILED DESCRIPTION OF EMBODIMENTS

Hereinafter, one or more embodiments of the present invention will be described with reference to the drawing. However, the scope of the invention is not limited to the disclosed embodiments.

1. Toner for Developing Electrostatic Charge Image

One embodiment of the present invention relates to a toner for developing an electrostatic charge image (electrostatic latent image) formed on an image carrier such as a photoreceptor. The above toner may be a one component developer or a two components developer containing carrier particles and toner particles.

The toner has toner base particles and an external additive adhering to the surface of the toner base particles. The toner base particles contain a binder resin and at least two kinds of organic pigments. The at least two kinds of organic pigments contain the following pigments P1 and pigments P2. The external additive contains alumina.

Pigment P1: A pigment having an absorption maximum wavelength λ max of larger than 400 nm and less than 600 nm when dispersed in methyl ethyl ketone Pigment P2: A pigment having an absorption maximum wavelength λ max of larger than 600 nm and less than 700 nm when dispersed in methyl ethyl ketone According to the findings of the present inventors, from the viewpoint of enhancing the concealability of a formed image, it is preferable that the two or more organic pigments include, when a visible light region (400 nm to 700 nm) is divided into two regions, a pigment P1 having an absorption maximum wavelength λ max in a short wavelength side region (a region in which a wavelength is larger than 400 nm and less than 600 nm), and a pigment P2 having an absorption maximum wavelength λ max in a long wavelength side region (a region in which a wavelength is 600 nm or more and 700 nm or less). With the use of these pigments P1 and P2, electromagnetic waves of a wider wavelength in the visible light region is sufficiently absorbed and the image is sufficiently blackened (concealability is enhanced).

According to another findings of the present inventors, when a toner contains two or more kinds of organic pigments, the total amount of the organic pigment in one toner base particles tends to become large, accompanied with the increase in the type of organic pigment. In addition, when organic pigments having a large resistance increases, the charging property of the toner becomes unstable as the amount of the organic pigments becomes large. Then, because of the unstable charging property, the toner may be excessively charged in a low temperature and low humidity (LL) environmental condition. As a result, the amount of charge of the toner greatly changes depending on the environmental conditions (for example, the difference in the environmental conditions between the LL environmental conditions and the high temperature and high humidity (HH)

environmental conditions in which the excessive charging of the toner does not occur so easily), and thus stability for image forming is decreased.

On the other hand, alumina contained as an external additive in the above toner has a lower resistance compared with other substances (for example, silica, and the like) used as an external additive. Thus, alumina acts as a resistance adjusting agent in the above toner, by which excessive charging of the toner, occurred as a result of increment of electric resistance due to the increment of the amount of the pigments, can be suppressed. On the other hand, alumina has a higher resistance compared with titania. Thus, alumina as a resistance adjusting agent in the above toner can ensure a suitable charging of the toner. Further, a surface treatment by alumina hardly results in an excessive amount of surface treatment of the toner base particles, and still further alumina enables an even treat of the toner base particle because aggregation of alumina particle hardly occurs. As such, alumina is considered to stabilize the charging property of the toner and enables stable image formation.

Hereinafter, the toner of the present invention based on the above technical concept will be described in more detail.

1-1. Toner Base Particles

The toner base particles have a binder resin and two or more kinds of organic pigments.

The toner base particles preferably have an average particle diameter on a volume basis of 5.0 μm or more and 8.0 μm or less, and more preferably 5.5 μm or more and 7.0 μm or less. By setting the average particle diameter on a volume basis of the toner base particles to 5.0 μm or more, the two or more kinds of pigments can be sufficiently internally added to the toner base particles thereby a good color developability can be obtained, and transfer efficiency of the toner can be increased. By setting the average particle diameter on a volume basis of the toner base particles to 8.0 μm or less, the resolution of the image to be formed can be further increased.

The average particle diameter on a volume basis of the toner base particles can be measured using a measuring device in which a computer system equipped with a soft Software V3.51 for data processing is connected to a particle size distribution measuring device (manufactured by Beckman Coulter Co., Ltd. Coulter Multisizer 3). Specifically, 0.02 g of a sample (toner base particles) is added to 20 mL of a surfactant solution (a surfactant solution for dispersing toner particles, obtained by diluting, for example, a neutral detergent containing a surfactant component 10 times with pure water) and adapted, and then subjected to an ultrasonic dispersion treatment for 1 minutes to prepare a dispersion of toner base particles. The dispersion is pipetted into a beaker containing an electrolyte (Beckman Coulter, ISOTONII) in the sample stand until the indicated density of the measuring device is 8% By setting this concentration, reproducible measurement values can be obtained. Then, in the measuring device, the number of measured particle counts is set to 25000 and the aperture diameter is set to 100 μm, and a measurement range of 2 to 60 μm is divided into 256 to calculate each frequency value, and based on this, an average particle diameter on a volume basis is calculated.

1-1-1. Binder Resin

The binder resin is preferably a thermoplastic resin.

Examples of the thermoplastic resins include styrene resins, vinyl resins (such as acrylic resins and styrene-acrylic resins), polyester resins, silicone resins, olefin resins, polyamide resins, and epoxy resins.

The binder resin may be an amorphous resin or a crystalline resin.

(Amorphous Resin)

In this specification, an amorphous resin means a resin in winch a melting point is not observed in measurement by differential scanning calorimetry (DSC: Differential Scanning Calorimetry) In this specification, when a melting point is observed in a resin, it means that a peak in which a half width of an endothermic peak is within 15° C. is observed when measured at a temperature rise rate of 10° C./min in DSC.

When the glass transition temperature observed in the first temperature rise process in DSC measurement is set as a $Tg_1$ and the glass transition temperature observed in the second temperature rise process is set as a $Tg_2$, the amorphous resin preferably has a $Tg_1$ of 35° C. or mom and 80° C. or less, and more preferably 45° C. or more and 65° C. or less. In addition, the amorphous resin preferably has a $Tg_2$ of 20° C. or more and 70° C. or less, more preferably 30° C. or more and 55° C. or less. When $Tg_1$ of the amorphous resin is 35° C. or more or $Tg_2$ is 20° C. or more, heat resistance (heat-resistant storage property, and the like) of the toner can be further increased. When $Tg_1$ of the amorphous resin is 80° C. or less or $Tg_2$ is 70° C. or less, low-temperature fixability of the toner can be further increased.

In this specification, the glass transition temperature (Tg) of the resin can be a value measured using a known DSC measuring machine (for example, Diamond DSC manufactured by Perkin Elmer Co., Ltd.). Specifically, 3.0 mg of the measurement sample (resin) is enclosed in an aluminum pan and set in a sample holder of a DSC measuring machine. Use empty aluminum bread for reference. Then, by the measurement conditions (heating and cooling conditions) of: a first heating process of raising the temperature from 0° C., at a heating rate of 10° C./min until 200° C.: a cooling process of cooling from 200° C., at a cooling rate of 10° C./min until 0° C.: and a second heating process of raising the temperature from 0° C., at a heating rate of 10° C./min until 200° C., are conducted through this order to obtain DSC curves. Based on the obtained DSC curves, an extension line of the baseline prior to the rise of the first endothermic peak in the respective temperature rise process and a tangent line indicating a maximum slope between the rising portion of the first peak and the peak apex are drawn, and the intersection point thereof is defined as the glass transition temperature ($Tg_1$ and $Tg_2$)

The content of the amorphous resin is preferably 20% by mass or more and 99% by mass or less, more preferably 30% by mass or more and 95% by mass or less, and still more preferably 40% by mass or more and 90% by mass or less, based on the total mass of the toner base particles. When the content of the amorphous resin is 20% by mass or more, the intensity of the image to be formed can be further increased.

Examples of the above-mentioned amorphous resins include styrene resins, vinyl resins, olefin resins, epoxy resins, amorphous polyester resins, polyurethane resins, polyamide resins, cellulose resins, and polyether resins. One kind of these resins may be used alone, or two or more kinds thereof may be used in combination. Of these, amorphous polyester resins and vinyl resins such as styrene-acrylic resins are preferred.

The amorphous polyester resin can enhance the low-temperature fixability of the toner. The amorphous polyester resin may be any amorphous resin obtained by a polycondensation reaction of a carboxylic acid having two or more valences (polyvalent carboxylic acid) and an alcohol having two or more valences (polyhydric alcohol). Examples of the polyvalent carboxylic acid include unsaturated aliphatic polyvalent carboxylic acids, aromatic polyvalent carboxylic acids, and derivatives thereof. As long as the obtained polyester resin becomes amorphous, a saturated aliphatic polyvalent carboxylic acid may be used in combination. Examples of the above polyhydric alcohol include unsaturated aliphatic polyhydric alcohols, aromatic polyhydric alcohols, and derivatives thereof. As long as the obtained polyester resin becomes amorphous, a saturated aliphatic polyhydric alcohol may be used in combination. The polyhydric fatty acids and polyhydric alcohols may be used alone or as a mixture of two or more thereof.

The vinyl resin can harden the toner base particles to suppress the burial of the external additive into the toner base particles, and thereby enhance the improvement effect of the charging property caused by alumina. Examples of the vinyl resins include (co)polymers of (meta)acrylic acid ester having straight-chain hydrocarbons of 6 to 30 carbon atoms, styrene (co)polymers. (co)polymers of other (meta)acrylic acid esters, (co)polymers of vinyl esters, (co)polymers of vinyl ethers. (co)polymers of vinyl ketones, and (co)polymers of acrylic acid or metallic acid.

The content of the vinyl resin is preferably 0.1% by mass or more and 20% by mass or less based on the total mass of the binder resin. When the content of the vinyl resin is 0.1% by mass or more, the effect of suppressing burial of the external additive is sufficiently exhibited. When the content of the vinyl resin is 20% by mass or less, the content of the other resin (particularly, an amorphous polyester resin) can be increased to easily enhance the low-temperature fixability of the toner.

(Crystalline Resin)

In this specification, a crystalline resin means a resin in which a melting point is observed in measurement by DSC.

The crystalline resin enhances the flexibility of the toner base particles and thereby enhances the bindability of alumina particles contained in the external additive.

The content of the crystalline resin is preferably 3% by mass or more and 30% by mass or less, more preferably 5% by mass or more and 20% by mass or less, based on the total mass of the toner base particles. When the content of the amorphous resin is 3% by mass or more, the fixability of the toner can be further increased.

Examples of the crystalline resins include styrene resins, vinyl resins, olefin resins, epoxy resins, amorphous polyester resins, polyurethane resins, polyamide resins, cellulose resins, and polyether resins. One kind of these resins may be used alone, or two or mom kinds thereof may be used in combination. Of these, amorphous polyester resins and vinyl resins such as styrene-acrylic resins are preferred.

The crystalline polyester resin can enhance the low-temperature fixability of the toner. The crystalline polyester resin may be any crystalline resin obtained by a polycondensation reaction of a carboxylic acid having two or more valences (polyvalent carboxylic acid) and an alcohol having two or more valences (polyhydric alcohol).

The polyvalent carboxylic acid can be selected from: a two valent aliphatic dicarboxylic acid including oxalic acid, succinic acid, glutaric acid, adipic acid, speric acid, azelaic acid, sebacic acid, 1,9-nonanedicarboxylic acid, 1,10-decanedicarboxylic acid, dodecanedicarboxylic acid (1,12-dodecanedicarboxylic acid), 1,14-tetradecanedicarboxylic acid, 1,18-octadecanedicarboxylic acid, and the like; and a two valent aromatic dicarboxylic acid including phthalic acid, isophthalic acid, terephthalic acid, naphthalene-2,6-dicarboxylic acid, malonic acid, mesaconic acid, and the like. These polyvalent carboxylic acids may be anhydrides or lower alkyl esters.

Alternatively, the above polyvalent carboxylic acid may be a carboxylic acid having three or more valences such as 1,2,4-benzenetricarboxylic acid, 1,2,5-benzenetricarboxylic acid, 1,2,4-naphthalenetricarboxylic acid, and the like, and an anhydride or a lower alkyl ester thereof. Further, unsaturated polyvalent carboxylic acids including maleic acid, fumaric acid, 3-hexenedioic acid, and 3-octenedioic acid and the like may be used.

The polyhydric alcohol is preferably an aliphatic diol, and more preferably a linear aliphatic diol having 7 or more and 20 or less carbon atoms in the main chain portion. In particular, the linear aliphatic diol easily enhances the crystallinity of the polyester resin and hardly lowers the melting temperature. Thus, the linear aliphatic diol can further enhance the blocking resistance, the image storage property, and the low-temperature fixability of the toner. When the number of carbon atoms of the linear aliphatic diol is 7 or more and 20 or less, the melting point at the time of polycondensation with the polyvalent carboxylic acid component can be made lower, and synthesis becomes easier.

Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, and 1,18-octadecanediol. Alternatively, an alcohol having 3 or more valences including glycerin, trimethylolethane, trimethylolpropane, pentaerythritol, and the like may be used.

The weight average molecular weight of the crystalline polyester resin is preferably 5.000 or more and 50,000 or less. Note that, in this specification, the weight average molecular weight of the crystalline polyester resin is a value measured by gel permeation chromatography (GPC), for example, by the following method.

Tetrahydrofuran (THF) is flowed as a carrier solvent at a flow rate of 0.2 mL/min while using HLC-8120GPC manufactured by Tosoh Corporation as a device and TSKguardcolum+TSKgelSuperHZ-M3 ream manufactured by Tosoh Corporation as a column and holding the column temperature at 40° C. As the measurement sample (resin), a solution dissolved in tetrahydrofuran so as to have a concentration of 1 mg/ml is used. The solution can be obtained by treatment with an ultrasonic disperser at room temperature for 5 minutes and then with a membrane filter with a pore size of 0.2 μm, 10 μL of this sample solution is injected into the apparatus together with the carrier solvent and detected using a refractive index detector (RI detector). The molecular weight distribution of the measurement sample is calculated based on a calibration curve generated using monodisperse polystyrene standard particles.

1-1-2. Organic Pigment

The organic pigment is a pigment composed of an organic compound. In this embodiment, for the purpose of adjusting the color to be developed and adjusting the physical properties of the toner, two or more kinds of pigments including the pigment P1 and the pigment P2 are internally added into one toner base particle.

From the viewpoint of absorbing electromagnetic waves of a wider wavelength in the visible light region and further reducing the visibility of the image as an image having higher black color, it is preferable that the two or more kinds of pigments be pigments which exhibit different color tones from each other. More specifically, it is preferable that the two or more kinds of pigments include a combination of organic pigments having a difference in absorption maximum wavelength λ max of 50 nm or more and 240 nm or less. Especially, the pigment P1 and the pigment P2 preferably contains a combination of pigments having a difference in absorption maximum wavelength λ max of 50 nm or more and 240 nm or less.

In this specification, the absorption maximum wavelength of the organic pigment is measured by: obtaining a dispersion by mixing 0.02 parts by weight of the organic pigment per 100 parts by weight of methyl ethyl ketone; the obtained dispersion is placed in a quartz cell for a spectrophotometer having an optical path length of 10 mm; the absorption spectrum is measured in a wavelength range of 400-700 nm by a spectrophotometer, and a value which becomes an absorption maximum was set as an absorption maximum wavelength.

Pigment P1 is a pigment having an absorption maximum wavelength a max of larger than 400 nm and less than 600 nm. In other words, pigment P1 is a pigment having, when a visible light region (400 nm to 700 nm) is divided into two regions, an absorption maximum wavelength λ max in a short wavelength side region (a region in which a wavelength is larger than 400 nm and less than 600 nm).

Pigment P1 is preferably C.I. Pigment Yellow 74, C.I. Pigment Yellow 120, C.I. Pigment Yellow 139, C.I. Pigment Yellow 151, C.I. Pigment Yellow 155, C.I. Pigment Yellow 180, C.I. Pigment Yellow 181, C.I. Pigment Yellow 185, C.I. Pigment Yellow 213, C.I. Pigment Green 7, C.I. Pigment Green 36, C.I. Pigment Green 254, C.I. Pigment Brown 23, C.I. Pigment Brown 25, C.I. Pigment Brown 41, C.I. Pigment Red 38, C.I. Pigment Orange 34, C.I. Pigment Orange 36, C.I. Pigment Orange 38, C.I. Pigment Orange 43, C.I. Pigment Orange 62, C.I. Pigment Orange 68, C.I. Pigment Orange 70, C.I. Pigment Orange 72, C.I. Pigment Orange 74, C.I. Pigment Red 31, C.I. Pigment Red 48:4, C.I. Pigment Red 57:1, C.I. Pigment Red 122, C.I. Pigment Red 146, C.I. Pigment Red 147, C.I. Pigment Red 150, C.I. Pigment Red 184, C.I. Pigment Red 238, C.I. Pigment Red 242, C.I. Pigment Red 254, C.I. Pigment Red 269, C.I. Pigment Violet 19, C.I. Pigment Violet 23, and C.I. Pigment Violet 32, and the like.

Further, from the viewpoint of more sufficiently absorbing electromagnetic waves having a wider wavelength in the visible light region, among a pigment P1-1 in which an absorption maximum wavelength λ max is larger than 400 nm and less than 460 nm, a pigment P1-2 in which an absorption maximum wavelength λ max is equal to or larger than 460 nm and equal to or smaller than 530 nm, and a pigment P1-3 in which an absorption maximum wavelength λ max is larger than 530 nm and smaller than 600 nm, it is preferable that the toner base particles include two or more of the pigment P1-1 to the pigment P1-3, and more preferably include all types thereof. In particular, when the toner base particles contain more kinds of pigments among the pigment P1-1 to the pigment P1-3, the charging property can be further stabilized and the fixability to the recording medium can be further increased. Further, even if any of the pigments fades, the other pigment can cover the wavelength range of the faded pigment, so that the light resistance of the formed image can be further increased. Further, according to the findings of the present inventors, the more the type of pigment, the higher the toner fixability, probably due to the higher dispersibility of the crystalline resin (particularly, a crystalline polyester resin).

From the viewpoint of sufficiently absorbing electromagnetic waves having a wider wavelength in the visible light region by appropriately combining these pigments, the pigment P1-1 is preferably a pigment having an absorption maximum wavelength a max of greater than 410 nm and less than 450 nm, and the pigment P1-2 is preferably a pigment having an absorption maximum wavelength λ max of greater than or equal to 480 nm and less than or equal to 510 nm, and the pigment P1-3 is preferably a pigment having an absorption maximum wavelength λ max of greater than 540 nm and less than 590 nm, and the pigment P2 is preferably a pigment having an absorption maximum wavelength λ max of greater than or equal to 620 nm and less than or equal to 660 nm.

The pigment P1-1 may be a monoazo pigment, a disazo pigment, a benzimidazoline pigment, an isoindolinone pigment, an isoindoline pigment and a perinone pigment, and the like. Specifically, the pigment P1-1 may be C.I. Pigment Yellow 1, C.I. Pigment Yellow 3, C.I. Pigment Yellow 12, C.I. Pigment Yellow 13, C.I. Pigment Yellow 14, C.I. Pigment Yellow 16, C.I. Pigment Yellow 17, C.I. Pigment Yellow 73, C.I. Pigment Yellow 74, C.I. Pigment Yellow 81, C.I. Pigment Yellow 83, C.I. Pigment Yellow 87, C.I. Pigment Yellow 97, C.I. Pigment Yellow Ill. C.I. Pigment Yellow 120, C.I. Pigment Yellow 126, C.I. Pigment Yellow 127, C.I. Pigment Yellow 128, C.I. Pigment Yellow 139, C.I. Pigment Yellow 151, C.I. Pigment Yellow 154, C.I. Pigment Yellow 155, C.I. Pigment Yellow 173, C.I. Pigment Yellow 174, C.I. Pigment Yellow 175, C.I. Pigment Yellow 176, C.I. Pigment Yellow 180, C.I. Pigment Yellow 181, C.I. Pigment Yellow 185, C.I. Pigment Yellow 191, C.I. Pigment Yellow 194, C.I. Pigment Yellow 196, C.I. Pigment Yellow 213, C.I. Pigment Yellow 214, C.I. Pigment Yellow 217, C.I. Pigment Green 7, C.I. Pigment Green 36, C.I. Pigment Green 254, and C.I. Pigment Orange 43, and the like.

Of these, as the pigment P1-1, C.I. Pigment Yellow 74, C.I. Pigment Yellow 120, C.I. Pigment Yellow 139, C.I. Pigment Yellow 151, C.I. Pigment Yellow 155, C.I. Pigment Yellow 180, C.I. Pigment Yellow 181, C.I. Pigment Yellow 185, C.I. Pigment Yellow 213, C.I. Pigment Green 7, C.I. Pigment Green 36, and C.I. Pigment Green 254 are preferred.

The pigment P1-2 is a pigment having an absorption maximum wavelength λ max in a central wavelength region of a wavelength region (400 nm to 600 nm) in which the pigment P1 may have an absorption maximum wavelength. Therefore, when the toner base particles contain the pigment P1-2, the image to be formed tends to absorb electromagnetic waves having a wider wavelength. In addition, the pigment P1-2 is often a pigment having low resistance, and it hardly causes a decrease in charging property due to excessive charging of the toner.

From the viewpoint of sufficiently absorbing electromagnetic waves having a wider wavelength in the visible light region, it is preferable that the pigment P1-2 has a half-value wavelength of 550 nm or more on the long wavelength side of the absorption spectrum.

Pigment P1-2 can be pigments such as monoazo pigments, disazo pigments, condensed azo pigments, naphthol AS pigments, benzimidazolone pigments, and the like. Specifically, the pigment P1-2 may be C.I. Pigment Brown 23, C.I. Pigment Brown 25, C.I. Pigment Brown 41, and C.I. Pigment Red 38, and the like. Of these, pigment P1-2 is preferably C.I. Pigment Brown 23 or C.I. Pigment Brown 25 and more preferably C.I. Pigment Brown 23.

The pigment P1-3 may be a monoazo pigment, a disazo pigment, a β-naphthol pigment, a naphthol AS pigment, an azolake pigment, a benzimidazolone pigment, an anthantron pigment, an anthraquinone pigment, a quinacridone pigment, a dioxazine pigment, a perylene pigment, a thioindigo pigment, a triarylcarbonium pigment and a diketopyrrolopyrrole pigment, and the like. Specifically, pigments P1-3 may be C.I. Pigment Orange 5, C.I. Pigment Orange 13, C.I.

Pigment Orange 34, C.I. Pigment Orange 36. C.I. Pigment Orange 38, C.I. Pigment Orange 43, C.I. Pigment Orange 62, C.I. Pigment Orange 68, C.I. Pigment Orange 70, C.I. Pigment Orange 72, C.I. Pigment Orange 74, C.I. Pigment Red 2 C.I. Pigment Red 3, C.I. Pigment Red 4, C.I. Pigment Red 5, C.I. Pigment Red 9 C.I. Pigment Red 12, C.I. Pigment Red 14. C.I. Pigment Red 31, C.I. Pigment Red 48:2, C.I. Pigment Red 48:3 C.I. Pigment Red 48:4, C.I. Pigment Red 53:1, C.I. Pigment Red 57:1, C.I. Pigment Red 112, C.I. Pigment Red 122, C.I. Pigment Red 144, C.I. Pigment Red 146, C.I. Pigment Red 147, C.I. Pigment Red 149, C.I. Pigment Red 150, C.I. Pigment Red 168. C.I. Pigment Red 169, C.I. Pigment Red 170, C.I. Pigment Red 175, C.I. Pigment Red 176, C.I. Pigment Red 177, C.I. Pigment Red 179, C.I. Pigment Red 181, C.I. Pigment Red 184, C.I. Pigment Red 185, C.I. Pigment Red 187, C.I. Pigment Red 188, C.I. Pigment Red 207, C.I. Pigment Red 208, C.I. Pigment Red 209, C.I. Pigment Red 210, C.I. Pigment Red 214, C.I. Pigment Red 238, C.I. Pigment Red 242, C.I. Pigment Red 247. C.I. Pigment Red 253, C.I. Pigment Red 254, C.I. Pigment Red 256, C.I. Pigment Red 257, C.I. Pigment Red 262, C.I. Pigment Red 263, C.I. Pigment Red 266, C.I. Pigment Red 269, C.I. Pigment Red 274, C.I. Pigment Violet 19. C.I. Pigment Violet 23, and C.I. Pigment Violet 32, and the like.

Of these, as the pigment P1-3, C.I. Pigment Orange 34, C.I. Pigment Orange 36, C.I. Pigment Orange 38, C.I. Pigment Orange 43 C.I. Pigment Orange 62, C.I. Pigment Orange 68, C.I. Pigment Orange 70, C.I. Pigment Orange 72, C.I. Pigment Orange 74, C.I. Pigment Red 31, C.I. Pigment Red 48:4 C.I. Pigment Red 57:1, C.I. Pigment Red 122, C.I. Pigment Red 146, C.I. Pigment Red 147, C.I. Pigment Red 150, C.I. Pigment Red 184, C.I. Pigment Red 238, C.I. Pigment Red 242, C.I. Pigment Red 254, C.I. Pigment Red 269, C.I. Pigment Violet 19, C.I. Pigment Violet 23. And C.I. Pigment Violet 32 are preferred.

Pigment P2 is a pigment having an absorption maximum wavelength λ max of larger than 60 nm and less than 700 nm. In other words, pigment P1 is a pigment having, when a visible light region (400 nm to 700 nm) is divided into two regions, an absorption maximum wavelength λ max in a long wavelength side region (a region in which a wavelength is larger than 6 and less than 700 nm).

Pigment P2 may be C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 15:5, C.I. Pigment Blue 15:6, C.I. Pigment Blue 16, C.I. Pigment Blue 56, C.I. Pigment Blue 60, C.I. Pigment Blue 61, and C.I. Pigment Blue 80, and the like.

Of these, from the viewpoint of making the hue better, further enhancing the conductivity and light resistance, and hardly reducing the transmittance of electromagnetic waves in the near-infrared region, the pigment P2 is preferably a phthalocyanine pigment. Examples of pigment P2 which is a phthalocyanine pigment include C.I. Pigment Blue 15, C.I. Pigment Blue 15:1, C.I. Pigment Blue 15.2, C.I. Pigment Blue 15:3, C.I. Pigment Blue 15:4, C.I. Pigment Blue 15:5, C.I. Pigment Blue 15:6 and C.I. Pigment Blue 16, and the like.

The pigments may contain carbon black. Carbon black enhanced concealability of an image. On the other hand, in view of preventing reduction the permeability of electromagnetic waves in the near infrared region due to the carbon black's ability to absorb lights of wide wavelength regions, and preventing destabilization of the charging property of the toner due to carbon black's high conductivity, it is preferable that the content of carbon black is more than 0% by mass and less than 1% by mass based on the total mass obtained by summing up the toner base particles and the external additive.

The total content of the above pigments is preferably 1% by mass or more and 30% by mass or less, more preferably 5% by mass or more and 20% by mass or less, and still more preferably 7% by mass or more and 20% by mass or less, based on the total mass of the toner base particles. By increasing the content of the pigments, it is possible to further improve the color developability of the image to be formed. On the other hand, when the total content of the pigments is 30% by mass or less, a sufficient amount of the binder resin can be contained in the toner base particles, so that the toner becomes flexible and the fixability of the image is sufficiently increased, and the desorption of alumina is less likely to occur.

Further, it is preferable that these pigment P1-t, pigment P1-2, pigment P1-3 and pigment P2 contain, by mass or less in total based on the total mass obtained by summing them, the pigment P2 in an amount of 18% by mass or more and 69% by mass or less, more preferably 35% by mass or more and 65% by mass or less, and still more preferably 40% by mass or more and 60% by mass or less. Further, it is preferable to contain the pigment P1 in an amount of 31% by mass or more and 69% by mass or less, more preferably 35% by mass or more and 65% by mass or less, still more preferably 40% by mass or more and 60% by mass or less, based on the total mass obtained by summing them.

Further, from the viewpoint of enhancing charging stability, these pigments preferably contain a pigment P1-2 in an amount of 31% by mass or more and 69% by mass or less, more preferably 35% by mass or more and 65% by mass or less, and still more preferably 40% by mass or more and 60% by mass or less, based on the total mass of the pigments.

Further, these pigments preferably contain a pigment P1-2 and pigment P2 in a total amount of 60% by mass or more and 100% by mass or less based on the total mass of the pigments. Still further, these pigments preferably contain a pigment P1-1 in an amount of 0% by mass or more and 40% by mass or less based on the total mass of the pigments. Still further, these pigments preferably contain a pigment P1-3 in an amount of 0% by mass or more and 40% by mass or less based on the total mass of the pigments.

It is preferable that the volume average particle size of the entire pigments is 10 nm or more and 1000 nm or less, more preferably 50 nm or more and 500 nm or less, still more preferably 80 nm or more and 300 nm or less. The volume average particle size may be decided based on the description of catalogue, or measured by particle size measuring apparatus (for example, UPA-150 manufactured by Microtrac Bell).

1-1-3. Other Ingredients

The toner base particles may contain other ingredients including a release agent (wax) and a charge control agent, and the like.

The release agent can enhance the releasability of the toner from the fixing member or the like.

Examples of the release agents include hydrocarbon waxes including polyethylene waxes, paraffin waxes, microcrystalline waxes, Fischer-Tropsch waxes and the like; dialkyl ketone waxes including distearyl ketone and the like; ester waxes including carnauba waxes, behenyl behenate, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, trimellitic acid tristearyl, distearyl maleate and the like; and amide waxes including ethylenediamine dibehenylamide, trimellitic acid tristearylamide and the like.

The content of the above release agent is preferably 2% by mass or more and 30% by mass or less, more preferably 5% by mass or more and 20% by mass or less, based on the total mass of the toner base particles. When the content of the above release agent is 2% by mass or more, the releasability of the toner from the fixing member is sufficiently increased. When the content of the above release agent is 30% by mass or less, a sufficient amount of the binder resin can be contained in the toner base particles, so that the fixability of the image is sufficiently increased.

The charge control agent can adjust the charging property of the toner base particles.

Examples of the charge control agent include a nigrosine dye, a metal salt of a naphthenic acid or a higher fatty acid, an alkoxylated amine, a quaternary ammonium salt compound, an azo metal complex, a salicylic acid metal salt or a metal complex thereof, and the like.

The content of the charge control agent is preferably 0.1% by mass or more and 10% by mass or less, more preferably 0.5% by mass or more and 5% by mass or less, based on the total mass of the binder resin. When an attempt is made to control the charging property of the toner by a method such as excessively adding the charge control agent, other characteristics of the toner base particles may vary greatly. In contrast, in this embodiment, by adjusting the charging property of the toner by strontium titanate, it is possible to adjust the charging property of the toner to a desired degree while satisfying other required characteristics.

1-2. External Additive

The external additive includes particles of alumina. The external additive may contain other components.

1-2-1. Alumina

Alumina can be a particle of aluminum oxide represented by $Al_2O_3$. The crystalline form of alumina may be any of α-type, γ-type, σ-type, and mixtures thereof. The shape of the alumina particles is not particularly limited, and may be any of cubic shapes, spherical shapes, and amorphous shapes.

From the viewpoint of moderately increasing the resistance and making the resistance of the alumina particles equal to that of the carrier particles used when the toner is a two component developer, it is preferable that the alumina particles are surface-modified by a hydrophobic treatment agent. The content of the hydrophobization treatment agent is preferably 20% by mass or less, and more preferably 10% by mass or less, of the hydrophobization treatment agent in a state of being liberated from the surface of the alumina particles when the extraction treatment shown below is conducted. When the ratio of the above hydrophobization treatment agent is 20% or less, it is less likely to cause a decrease in fluidity of the toner due to aggregation of the liberated surface treatment agent, and it is also possible to further enhance the charge stability of the toner by enhancing the mixing property of the toner particles and the carrier particles.

In addition, from the viewpoint of further enhancing the fluidity and charging stability, it is preferable that the alumina particles have a total amount of carbon derived from the above hydrophobization treatment agent of 0.5% by mass or more and 10% by mass or less.

(Measurement Method)

(1) Quantify the amount of carbon contained by 0.7 g of alumina particles Quantitation can be performed, for example, by an elemental CHN analyzer (SUMIGRAPH NC-TR22 manufactured by Sumika Analysis Center). Note that the amount of carbon measured at this time is the total amount of carbon derived from the above hydrophobization treatment agent contained in the alumina particles.

(2) Using a Soxhlet extractor manufactured by BUCHI, place the above-mentioned alumina particle powder in a cylindrical filter paper (outer size: 28 mm×100 mm), and remove the hydrophobic treatment agent liberated from the alumina particle powder using an extracting solvent (for example, 30 to 100 mL of n-hexane) at a temperature of 68° C. to 110° C. under a condition of an extraction time of 60 minutes and a rinsing time of 30 minutes.

(3) The amount of carbon contained in the alumina particles after carrying out the above extraction operation is quantified. Quantification is performed in the same manner as in (1).

(4) The ratio of the hydrophobizing treatment agent in a state of being liberated from the surface of the alumina particles is calculated by the following formula.

$$(C0-C1)/C0\times100(\%)$$

C0: The total amount of carbon derived from the hydrophobic treatment agent present on the alumina particle surface before the extraction operation C1: The total amount of carbon derived from the hydrophobic treatment agent present on the alumina particle surface after the extraction operation The above hydrophobic treatment agent may be various coupling agents, silicone oils, fatty acids and fatty acid metal salts, and the like, preferably a silane compound or a silicone oil.

Examples of the silane compound include chlorosilane, alkoxysilane, silazane, and special silylating agents. Examples of the silane compound include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltriethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, octyltrimethoxysilane, decyltrimethoxysilane, hexamethyldisilazane, N,O-(bistrimethylsilyl)acetamide. N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclolexyl)ethyltrimethoxysilane. γ-glycidoxypropyltrimethoxysilane, γ-glycidoxypropylmethyldiethoxysilane, γ-mercaptopropyltrimethoxysilane, and γ-chloropropyltrimethoxysilane, and the like. Of these, isobutyltrimethoxysilane, and octyltrimethoxysilane are preferred.

Examples of the above silicone oils include cyclic compounds including organosiloxane oligomers, octamethyilcyclotetrasiloxane, decamethylcyclopentasiloxane, tetramethylcyclotetrasiloxane, and tetravinyltetramethylcyclotetrasiloxane, and the like, and linear or branched organosiloxanes, and the like. Note that the above silicone oil may be a modified silicone oil in which a modifying group is introduced into a side chain, a single end, both ends, and a side chain single end, and the like. Examples of such modifying groups include alkoxy group, carboxyl group, carbinol group, higher fatty acid modifying group, phenolic group, epoxy group, acryloyl group, methacryloyl group, and amino group. Further, the silicone oil may be a silicone oil having more than two kinds of modified groups such as amino/alkoxy modification. Further, the above silicone oil may be a mixture of dimethylsilicone oil and these modified silicone oils, or may be a mixture of other surface treatment agents. For example, the silicone oil may be a mixture with a silane coupling agent, a titanate-based coupling agent, an aluminate-based coupling agent, various silicone oils, fatty acids and fatty acid metal salts and esterifies thereof, and Rosin Acid and the like.

The alumina can be produced by a known method. As a method of producing alumina, a buyer method is generally used. Otherwise, a hydrolysis method, a gas phase synthesis method, a flame hydrolysis method, and an underwater spark discharge method may be used in order to obtain alumina of high purity and nano size. Alumina particles produced by these methods can be surface-modified by a hydrophobization treatment agent in a known manner. Examples of the surface modification method include a dry method such as a spray drying method in which a solution containing a treatment agent or a treatment agent is sprayed on particles suspended in a gas phase, a wet method in which particles are immersed in a solution containing a treatment agent and dried, and a mixing method in which the treatment agent and the particles are mixed by a mixer.

From the viewpoint of further enhancing the charging stability of the toner, the number average primary particle diameter of the alumina particles is preferably 5 nm or more and 60 nm or less, and more preferably Stun or more and 4 nm or less. By using alumna particles of such a small particle diameter within a range of 5 to 60 nm, the fluidity of the toner is improved, and transfer of the alumina particles from the toner particles to the carrier particles becomes easy and the variation in the charge amount particularly during high coverage printing can be stabilized.

The particle size of the alumina particles can be determined by taking an SEM photograph of a toner enlarged at 30000 times using a scanning electron microscope (SEM) (manufactured by Nippon Electronics Co., Ltd., JSM-7401F), observing the SEM photograph, measuring the particle size (Ferry diameter) of the primary particles of the silica particles, and dividing the total value by the number. The measurement of the particle size can be performed by selecting a region such that the total number of particles is about 100 to 200 in the SEM image.

The content of the alumina particles is preferably 0.1% by mass or more and 2.0% by mass or less based on the total mass of the toner particles. When the above content is 0.1% by mass or more, the charging stability of the toner is further increased. When the above content is 2.0% by mass or less, burial of alumina particles into toner base particles due to collision between toner particles and carrier particles when the developer is stirred in the developer during low coverage printing can be hardly caused.

1-2-2. Other External Additives

The external additive may include particles mainly containing an inorganic material other than alumina, such as silica particles, strontium titanate particles, zirconia particles, zinc oxide particles, chromium oxide particles, cerium oxide particles, antimony oxide particles, tungsten oxide particles, tin oxide particles, tellurium oxide particles, manganese oxide particles and boron oxide particles. Particles containing these inorganic materials as a main component may be subjected to a hydrophobic treatment by a surface treatment agent such as a silane coupling agent or a silicone oil, if necessary. These particles preferably have a particle diameter of a peak top measured by a method similar to that of alumina of 20 nm or more and 500 nm, and more preferably 70 nm or more and 300 nm or less.

The external additive may contain particles mainly containing an organic material containing a homopolymer such as styrene or methyl methacrylate or a copolymer thereof. It is preferable that these particles have a particle diameter of a peak top measured by a method similar to that of alumina of 10 nm or more and 1000 nm or less.

The external additive may contain a lubricant such as a metal salt of a higher fatty acid. Examples of the higher fatty acid include stearic Acid, oleic acid, palmitic acid, linoleic acid and ricinoleic acid and the like. Examples of the metal constituting the above metal salt include zinc, manganese, aluminum, iron, copper, magnesium and calcium.

The content of these external additives is preferably an amount in which the total amount of the external additive combined with alumina is 0.05% by mass or more and 5.0% by mass or less based on the total mass of the toner base particles.

1-3. Method for Producing Toner Base Particles

The toner base particles can be produced in the same manner as a known toner, by an emulsion polymerization aggregation method, an emulsion aggregation method and the like.

According to the emulsion polymerization aggregation method, a dispersion of particles of a binder resin obtained by an emulsion polymerization method and a dispersion of particles of a pigment are mixed together with particles such as a releasing agent and a charge control agent to be optionally added, and these are aggregated, associated or fused until particles having a desired particle diameter are obtained, and then an external additive is added.

According to the emulsion aggregation method, a dispersion of particles of a binder resin obtained by dropping a solution obtained by dissolving a binder resin into a poor solvent can be obtained by mixing a dispersion of particles of a pigment with particles such as a releasing agent and a charge control agent to be optionally added, aggregating, associating or fusing them until particles having a desired particle diameter are obtained, and then adding an external additive.

In this embodiment, since two or more kinds of pigments are internally added to the toner particles, the amount of the pigment added tends to be large. Therefore, when preparing a dispersion of particles of a pigment, it is preferable to add a surfactant to the dispersion in order to enhance dispersion stability of the pigment.

1-4. Carrier

The carrier is mixed with the toner particles described above to constitute a two components magnetic toner. The carrier may be any known magnetic particles which may be contained in a toner.

Examples of the magnetic particles include particles including magnetic materials such as ion, steel, nickel, cobalt, ferrite, and magnetite, and alloys of these with aluminum and lead. The above carrier may be a coated carrier in which a surface of particles made of the magnetic materials is coated with a resin or the like, or may be a resin dispersion type carrier in which the above-mentioned magnetic body is dispersed in a binder resin. Examples of the resin for coating include olefin resins, styrene resins, styrene-acrylic resins, silicone resins, polyester resins, and fluororesins. Examples of the binder resins include acrylic resins, styrene-acrylic resins, polyester resins, fluororesins, and phenolic resins.

The average particle diameter of the carrier preferably is 20 μm or more and 100 μm or less, and more preferably 25 μm or more and 80 μm or less, on a volume basis. Average particle size of the carrier can be measured by a laser diffractive particle size distribution measuring device with a wet disperser made by Sympatec (SYMPATEC) Co., Ltd. (HELOS) or the like.

The content of the carrier is preferably 2% by mass or more and 10% by mass or less based on the total mass of the toner particles and the carrier.

2. Image Forming Apparatus

Another embodiment of the present invention relates to an image forming apparatus including a toner image forming unit that develops an electrostatic latent image with toner to form a toner image, a fixing device that fixes the toner image to the recording medium by transferring the toner image to a recording medium, and an image forming method using the image forming layer. In this embodiment, the fixing device fixes the above-described toner to the recording medium.

The image forming apparatus may be a 4 cycle type image forming apparatus constituted by 4 color developing devices of yellow, magenta, cyan, and black, and 1 electrophotographic photoreceptors, or may be a tandem type image forming apparatus constituted by 4 color developing devices of yellow, magenta, cyan, and black, and 4 electrophotographic photoreceptors provided for each color.

FIG. 1 is a schematic configuration diagram illustrating an example of an image forming apparatus 100 relating to the present embodiment. The image forming apparatus 100 illustrated in FIG. 1 includes an image reading unit 110, an image processing unit 30, an image forming unit 40, a paper conveying unit 50, and a fixing device 60.

The image forming unit 40 has an image forming unit 41Y, 41M, 41C and 41K for forming an image by each color toner of Y (yellow), M (magenta), C (cyan), and K (black). Since all of these units have the same configuration except for the toner to be stored, a symbol representing a color may be omitted hereinafter. The image forming unit 40 further includes an intermediate transfer unit 42 and a secondary transfer unit 43, these correspond to transfer devices.

In this embodiment, the toner described above is used as a toner of K.

The image forming unit 41 includes an exposure device 411, a developing device 412, an electrophotographic photoreceptor (image carrier) 413, a charging device 414, and a drum cleaning device 415. The charging device 414 is, for example, a corona charger. The charging device 414 may be a contact charging device in which a contact charging member such as a charging roller, a charging brush, or a charging blade is brought into contact with the electrophotographic photoreceptor 413 so as to be charged. The exposure apparatus 411 includes, for example, a semiconductor laser as a light source and an optical deflection apparatus (polygon motor) that irradiates a laser beam corresponding to an image to be formed toward the electrophotographic photoreceptor 413. The electrophotographic photoreceptor 413 is a negatively charged organic photoreceptor having photoconductivity. The electrophotographic photoreceptor 413 is charged by a charging device 414.

The developing apparatus 412 is a developing device of a two components development system. The developing device 412 includes, for example, a developing container containing a two components developer, a developing roller (magnetic roller) rotatably disposed at an opening of the developing container, a partition wall for defining the wall of the developing container while the two components developer can move inside the developing container, a conveying roller for conveying the two components developer on the side of the opening in the developing container toward the developing roller, and a stirring roller for stirring the two components developer in the developing container. In the developing container, for example, a two components developer is contained.

The intermediate transfer unit 42 includes an intermediate transfer belt (intermediate transfer body) 421, a primary transfer roller 422 that presses the intermediate transfer belt 421 against the electrophotographic photoreceptor 413, a plurality of support rollers 423 including a backup roller 423A, and a belt cleaning device 426. The intermediate transfer belt 421 is looped over a plurality of support rollers 423. As at least one driving roller of the plurality of support rollers 423 rotates, the intermediate transfer belt 421 travels at a constant speed in the direction of the arrow A.

The belt cleaning device 426 has an elastic member 426*a*. The elastic member 426*a* abuts on the intermediate transfer belt 421 after the secondary transfer to remove the adhered matter on the surface of the intermediate transfer belt 421 The elastic member 426*a* is formed of an elastic body, and includes a cleaning blade, a brush, and the like.

The secondary transfer unit 43 has an endless secondary transfer belt 432, and a plurality of support rollers 431 including a secondary transfer roller 431A. The secondary transfer belt 432 is looped by a secondary transfer roller 431A and a support roller 431.

The fixing device 60 includes, for example, a fixing roller 62, an endless heat generating belt 10 that covers the outer peripheral surface of the fixing roller 62 and heats and melts the toner constituting the toner image on the sheet S, and a pressing roller 63 that presses the sheet S toward the fixing roller 62 and the heat generating belt 10. The sheet S corresponds to a recording medium.

The image forming apparatus 100 further includes an image reading unit 110, an image processing unit 30, and a sheet conveying unit 50. The image reading unit 110 includes a paper feeding device 111 and a scanner 112. The paper conveying unit 50 includes a paper feeding unit 51, a paper discharge unit 52, and a conveyance path unit 53. The three paper feed tray units Sla to Sic constituting the paper feed unit 51 store the sheet S (any of standard paper and special paper) identified based on the basis weight, the size, and the like for each set type in advance. The transport path unit 53 has a plurality of transport roller pairs such as a resist roller pair 53*a*.

Formation of an image by the image forming apparatus 100 will be described.

The scanner 112 optically scans and reads the document D on the contact glass. Reflected light from the document D is read by the CCD sensor 112*a* and becomes input image data. The input image data is subjected to predetermined image processing in the image processing unit 30 and is sent to the exposure apparatus 411.

The electrophotographic photoreceptor 413 rotates at a constant circumferential speed. The charging device 414 uniformly charges the surface of the electrophotographic photoreceptor 413 to a negative polarity. In the exposure apparatus 411, the polygon mirror of the polygon motor rotates at a high speed, and the laser beam corresponding to the input image data of each color component is developed along the axial direction of the electrophotographic photoreceptor 413 and is irradiated to the outer peripheral surface of the electrophotographic photoreceptor 413 along the axial direction. Thus, an electrostatic latent image is formed on the surface of the electrophotographic photoreceptor 413.

In the developing device 412, toner particles are charged by stirring and conveying of the two components developer in the developing container, and the two components developer is conveyed to the developing roller to form a magnetic brush on the surface of the developing roller. The charged toner particles electrostatically adhere from the magnetic brush to the portion of the electrostatic latent image in the electrophotographic photoreceptor 413. In this way, the electrostatic latent image of the surface of the electrophotographic photoreceptor 413 is visualized, and a toner image corresponding to the electrostatic latent image is formed on the surface of the electrophotographic photoreceptor 413. The "toner image" refers to a state in which the toner is assembled in an image form.

The toner image on the surface of the electrophotographic photoreceptor 413 is transferred to the intermediate transfer belt 421 by the intermediate transfer unit 42. The transfer residual toner remaining on the surface of the electrophotographic photoreceptor 413 after transfer is removed by a drum cleaning device 415 having a drum cleaning blade which is slidably brought into contact with the surface of the electrophotographic photoreceptor 413.

By pressing the intermediate transfer belt 421 against the electrophotographic photoreceptor 413 by the primary transfer roller 422, a primary transfer nip is formed for each electrophotographic photoreceptor by the electrophotographic photoreceptor 413 and the intermediate transfer belt 421. In the primary transfer nip, toner images of each color are sequentially overlapped and transferred onto the intermediate transfer belt 421.

On the other hand, the secondary transfer roller 431A is pressed against the back-up roller 423A via the intermediate transfer belt 421 and the secondary transfer belt 432. Thereby, a secondary transfer nip is formed by the intermediate transfer belt 421 and the secondary transfer belt 432. Sheet S passes through the secondary transfer nip. The sheet S is conveyed to the secondary transfer nip by the sheet conveying unit 50. The correction of the inclination of the sheet S and the adjustment of the timing of the conveyance are performed by the resist roller portion in which the resist roller pair 53*a* is disposed.

When the sheet S is conveyed to the secondary transfer nip, a transfer bias is applied to the secondary transfer roller 431A. By applying this transfer bias, a toner image carried on the intermediate transfer belt 421 is transferred onto the sheet S (a step of adhering the toner for developing an electrostatic charge image to the recording medium). The sheet S to which the toner image has been transferred is conveyed toward the fixing device 60 by the secondary transfer belt 432.

Attachments such as transfer residual toner remaining on the surface of the intermediate transfer belt 421 after the secondary transfer are removed by the belt cleaning device 426 having a cleaning blade which is slidably brought into contact with the surface of the intermediate transfer belt 421. At this time, since the aforementioned intermediate transfer member is used as the intermediate transfer belt, the dynamic friction force can be reduced over time.

The fixing device 60 forms a fixing nip by the heat generating belt 10 and the pressure roller 63, and heats and pressurizes the conveyed sheet S at the fixing nip section. Thus, the toner image is fixed to the sheet S (a step of fixing the toner for electrostatic charge image development to the recording medium). The sheet S on which the toner image is fixed is discharged outside the machine by a sheet discharge unit 52 provided with a sheet discharge roller 52*a*.

Note that the apparatus configuration and the image forming method described above are exemplary forms for carrying out the present invention, and the present invention is not limited thereto.

For example, a monochromatic image using only the above-mentioned toners may be formed, or an image using only the above-mentioned toners toner and the toner that absorbs electromagnetic waves in the near-infrared region may be formed, by an apparatus corresponding thereto.

EXAMPLES

Hereinafter, the present invention will be described in more detail with reference to Examples, but the present invention is not limited thereto.

Note that, in the following examples, when there is no particular reference, the average particle diameter of each particle is a value measured using Microtrack Co., Ltd., Microtrack UPA-150 ("MICROTRAC, registered trademark of the company).

1. Preparation of the Toner 1-1. Preparation of Pigment Particle Dispersions 1-1-1. Preparation of Pigment Particle Dispersion (1)

Pigment Brown 25 (PBr25): 40 parts by mass
Pigment Blue 15:3 (PB15:3): 25 parts by mass
Pigment Violet 23 (PV23): 10 parts by mass
Pigment Yellow 155 (PY155): 25 parts by mass
Anionic surfactant: 15 parts by mass
Ion exchange water: 400 parts by mass The above components were mixed and pre-dispersed by a homogenizer (manufactured by IKA Co., Ltd., Ultratalax) for 10 minutes, and then subjected to a dispersion treatment using a high pressure impact type disperser (manufactured by Sugino Machine Co., Ltd., Altimizer) for 30 minutes 245 MPa pressure to obtain an aqueous dispersion of particles containing these pigments. A pigment particle dispersion (1) was prepared by adding ion-exchanged water to the obtained dispersion to adjust the solid content to 15% by mass. The average particle diameter on a volume basis of the pigment particles in the pigment particle dispersion (1) was 150 nm.

The above anionic surfactant is Neogen RK manufactured by Dai-ichi Kogyo Seiyaku Co., Ltd ("Neogen" is a registered trademark of the company).

1-1-2. Preparation of Pigment Particle Dispersion (2) to Preparation of Pigment Particle Dispersion (15)

Pigment particle dispersion (2) to pigment particle dispersion (15) were prepared in the same manner as in the preparation of the pigment particle dispersion (1), except that the content of each pigment was changed according to table 1 while the total amount of the pigment was maintained as 100 parts by mass. The carbon black in the table is Regal 330 manufactured by Cabot Corp.

The number appeared in parenthesis of table 1 shows the wavelength range in which the absorption maximum wavelength λ max of each pigment is included.

TABLE 1

| Pigment particle dispersion | Organic pigment | | | | | | | | |
|---|---|---|---|---|---|---|---|---|---|
| | P1 | | | | | | | | |
| | P1-1 (400~460 nm) | | P1-2 (460~530 nm) | | P1-3 (530~600 nm) | | P2 (600~700 nm) | | CB |
| No. | Name | Parts | Name | Parts | Name | Parts | Name | Parts | parts |
| (1) | PY 155 | 2.5 | PBr 25 | 4.0 | PV 23 | 1 | PB 15:3 | 2.5 | — |
| (2) | PY 155 | 2.5 | PBr 25 | 3.2 | PV 23 | 1 | PB 15:3 | 2.5 | 0.8 |

TABLE 1-continued

| Pigment particle dispersion No. | Organic pigment P1 P1-1 (400~460 nm) Name | Parts | P1-2 (460~530 nm) Name | Parts | P1-3 (530~600 nm) Name | Parts | P2 (600~700 nm) Name | Parts | CB parts |
|---|---|---|---|---|---|---|---|---|---|
| (3) | — | — | PBr 25 | 6.0 | — | — | PB 15:3 | 4.0 | — |
| (4) | — | — | PBr 25 | 5.2 | — | — | PB 15:3 | 4.0 | 0.8 |
| (5) | PY 155 | 3.5 | — | — | PV 23 | 2.5 | PB 15:3 | 4.0 | — |
| (6) | — | — | — | — | PV 23 | 4.0 | PB 15:3 | 6.0 | — |
| (7) | — | — | — | — | PV 23 | 3.2 | PB 15:3 | 6.0 | 0.8 |
| (8) | PY 155 | 2.5 | PBr 25 | 5.0 | PV 23 | 1.0 | PB 15:3 | 1.5 | — |
| (9) | PY 155 | 2.5 | PBr 25 | 2.5 | PV 23 | 1.0 | PB 15:3 | 4.0 | — |
| (10) | PY 180 | 2.5 | PBr 25 | 4.0 | PV 23 | 1.0 | PB 15:3 | 2.5 | — |
| (11) | PY 180 | 2.5 | PBr 23 | 4.0 | PV 23 | 1.0 | PB 15:3 | 2.5 | — |
| (12) | PY 155 | 2.5 | PBr 25 | 6.5 | PV 23 | 1.0 | — | — | — |
| (13) | — | — | — | — | — | — | PB 15:3 | 9.2 | 0.8 |
| (14) | — | — | — | — | — | — | — | — | 10.0 |
| (15) | PY 155 | 2.5 | PBr 25 | 3.3 | PV 23 | 1.0 | PB 15:3 | 3.3 | — |

The absorption maximum wavelength λ max (nm) of each pigment used in preparing the pigment particle dispersion when dispersed in methyl ethyl ketone is as shown in Table 2.

TABLE 2

| Type of Pigment | Name of Pigment | λ max |
|---|---|---|
| P1-2 | PBr23 | 490 nm |
| P1-2 | PBr25 | 490 nm |
| P2 | PB15:3 | 630 nm |
| P1-3 | PV23 | 570 nm |
| P1-1 | PY155 | 405 nm |
| P1-1 | PY180 | 420 nm |

The average particle diameter on a volume basis of the pigment particles in the pigment particle dispersion (1) to pigment particle dispersion (15) were each 150 nm.

1-2. Preparation of Amorphous Resin Particle Dispersions 1-2-1. Preparation of Amorphous Polyester Resin Particle Dispersion (a1)

Bisphenol A ethylene oxide 2.2 molar adduct: 40 parts by mole

Bisphenol A propylene oxide 2.2 molar adduct: 60 parts by mole

Dimethyl terephthalate: 60 parts by mole

Dimethyl fumarate: 15 parts by mole

Dodecenyl succinic anhydride: 20 parts by mole

Trimellitic anhydride: 5 parts by mole

A monomer other than dimethyl fumarate and trimellitic anhydride among the above monomers and tin dioctylate in an amount of 0.25 parts by mass per 100 parts by mass of the total of the above monomers were charged into a reaction vessel equipped with a stirrer, a thermometer, a capacitor and a nitrogen gas introduction pipe. Under a stream of nitrogen gas, the mixture was allowed to react for 6 hours at 235° C., and then cooled to 200° C., and the above amount of dimethyl fumarate and trimellitic anhydride were added and reacted for 1 hours. The temperature was increased over 5 hours to 220° C., and the mixture was polymerized to a desired molecular weight under a pressure of 10 kPa to obtain a pale yellow transparent amorphous polyester resin (A1).

The amorphous polyester resin (A1) had a weight average molecular weight of 35,000, a number average molecular weight of 8000, and a glass transition temperature (Tg) of 56° C.

Then, 200 parts by mass of an amorphous polyester resin (A1), 100 parts by mass of methyl ethyl ketone, 35 parts by mass of isopropyl alcohol, and 7.0 parts by mass of a 10% by mass aqueous ammonia solution were placed in a separable flask, mixed and dissolved thoroughly, and then, while heating and stirring at 40° C., ion-exchanged water was dropped using a liquid feed pump at a liquid feed rate of 8 g/min, and dropping was stopped when the liquid feed amount became 580 parts by mass. Thereafter, solvent removal was performed under reduced pressure to obtain an amorphous polyester resin particle dispersion. Ion-exchanged water was added to the above dispersion to adjust the solid content to 25% by mass to prepare an amorphous polyester resin particle dispersion (a1). The average particle diameter on a volume basis of the amorphous polyester resin (A1) in the amorphous polyester resin particle dispersion (a1) was 56 nm.

1-2-2. Preparation of Styrene-Acrylic Resin Particle Dispersion (b1)

Styrene: 903.0 parts by mass

N-butyl acrylate: 282.0 parts by mass

Acrylic acid: 12.0 parts by mass 1,10-decanediol diacrylate: 3.0 parts by mass

Dodecanethiol: 8.1 parts by mass

A 5 L reaction vessel fitted with a stirring device, a temperature sensor, a cooling pipe and a nitrogen introducing device was charged with 5.0 parts by mass of an anionic surfactant (Dow Chemical Co., Ltd., Dowfax 2A1, "Dowfax" is a registered trademark of the company) and 2500 parts by mass of ion-exchanged water, and the internal temperature was raised to 75° C. while stirring at a stirring speed of 230 rpm under a nitrogen stream.

Then, a solution obtained by dissolving 18.0 parts by mass of potassium persulfate (KPS) in 342 parts by mass of ion-exchanged water was added, and the liquid temperature was set at 75° C. Further, a mixture of the above monomers was added dropwise over a period of 2 hours. After completion of the dropwise addition, the mixture was polymerized by heating and stirring at 75° C. for 2 hours to obtain an amorphous vinyl resin dispersion. Ion-exchanged water was added to the dispersion to adjust the solid content to 25 mass %, thereby prepared a dispersion (b1) of amorphous vinyl resin (B1) particles. The average particle diameter on a volume basis of the amorphous vinyl resin (B1) was 160 nm.

The amorphous vinyl resin (B1) had a weight average molecular weight (Mw) of 38,000, a number average molecular weight (Mn) of 15,000, and a glass transition temperature (Tg) of 52° C.

1-3. Preparation of Crystalline Resin Particle Dispersions 1-3-1. Preparation of Crystalline Polyester Resin Particle Dispersion (c1)

Dodecanediacid: 50 parts by mole 1,6-hexanediol: 50 parts by mole

The above monomer was put into a reaction vessel equipped with a stirrer, a thermometer, a capacitor and a nitrogen gas introduction pipe, and the inside of the reaction vessel was replaced with dry nitrogen gas. Then, titanium tetrabutoxide ($Ti(O\text{-}n\text{-}Bu)_4$) in an amount of 0.25 parts by mass based on 100 parts by mass of the above monomer was charged. After stirring and reacting under a stream of nitrogen gas for 3 hours at 170° C. the temperature was further increased over a period of 1 hours to 210° C., the inside of the reaction vessel was reduced in pressure to 3 kPa, and stirred under reduced pressure for 13 hours to react, thereby obtaining a crystalline polyester resin (C). The crystalline polyester resin (C1) had a weight average molecular weight of 25,000, a number average molecular weight of 8500, and a melting point of 71.8° C.

Next, 200 parts by mass of the crystalline polyester resin (C1), 120 parts by mass of methyl ethyl ketone, and 30 parts by mass of isopropyl alcohol were placed in a separable flask, sufficiently mixed and dissolved at 60° C., and then 8 parts by mass of an aqueous 10% by mass ammonia solution was added dropwise. The heating temperature was lowered to 67° C., and dropping was performed using an ion exchange water feed pump while stirring at a liquid feed rate of 8 g/min, and when the liquid feed amount became 580 parts by mass, dropping of ion exchange water was stopped. Thereafter, solvent removal was performed under reduced pressure to obtain a crystalline polyester resin particle dispersion. Ion-exchanged water was added to the above dispersion to adjust the solid content to 25% by mass to prepare a crystalline polyester resin particle dispersion (c1). The average particle diameter on a volume basis of the crystalline polyester resin (C1) in the crystalline polyester resin particle dispersion (c1) was 198 nm.

1-4. Preparation of Mold Release Agent Particle Dispersion (W1)

Paraffin wax: 270 parts by mass

Anionic surfactant: 13.5 parts by mass (60% active ingredient, 3% based on paraffin wax)

Ion exchange water: 21.6 parts by mass

The above materials were mixed, and the release agent was dissolved in a pressure discharge type homogenizer (Gorin Co., Ltd., Gorin homogenizer) at an internal liquid temperature of 120° C. followed by a dispersion treatment with a dispersion pressure of 5 MPa for 120 minutes, followed by a dispersion treatment with 40 MPa for 360 minutes, and then cooled to obtain a dispersion. Ion-exchanged water was added to adjust the solid content to 20% to prepare a release agent dispersion (W1). The average particle diameter on a volume basis of particles in the release agent dispersion (W1) was 215 nm.

The above paraffin wax is HNP0190 (melting temperature: 85° C.) manufactured by Nippon Seiwax Co., Ltd., and the above anionic surfactant is Neogen RK manufactured by Dai-ichi Kogyo Seiyaku Co., Ltd.

1-5. Preparation of Toner Base Particles 1-5-1. Preparation of Toner Base Particles (1)

Amorphous polyester resin particle dispersion (a1): 1280 parts by mass

Crystalline polyester resin particle dispersion (c1): 160 parts by mass

Release agent particle dispersion (W1) 200 parts by mass

Pigment particle dispersion (1): 335 parts by mass

Anionic surfactant: 40 parts by mass

Ion exchange water: 1500 parts by mass

A 4 liter reaction vessel equipped with a thermometer, a pH meter and a stirrer was charged with the above material, and a 1.0% by mass aqueous nitric acid solution was added under a temperature of 25° C. to adjust the pH to 3.0. Thereafter, 100 parts by mass of an aqueous solution of 20% by mass aluminum sulfate (flocculant) was added over 30 minutes while being dispersed at 3,000 rpm in a homogenizer (manufactured by IKA Corporation, Ultratalax T50). After completion of the dropping, the mixture was stirred for 10 minutes, and the raw material and the flocculant were thoroughly mixed.

Thereafter, a stirrer and a mantle heater are installed in the reaction vessel, while adjusting the number of revolutions of the stirrer so that the slurry is sufficiently stirred, the slurry was heated at a temperature rise rate of 0.2° C./min up to a temperature of 40° C., and a temperature rise rate of 0.05° C./min after exceeding 40° C., and particle size was measured every 10 minutes by a particle size distribution measuring device (manufactured by Beckman Coulter Co., Ltd., Coulter Multisizer 3 (aperture diameter 100 μm)). The temperature was held at a point where the average particle diameter on a volume basis became 5.9 μm, and a mixed liquid of the following materials prepared in advance was charged over a period of 20 minutes.

Amorphous polyester resin particle dispersion (a1): 160 parts by mass

Anionic surfactant: 15 parts by mass

Both of the anionic surfactants charged 2 times described above are Dowfax 2A1 (20% aqueous solution) manufactured by Dow Chemical Co., Ltd.

Then, after holding at 50° C. for 30 minutes, 8 parts by mass of an aqueous solution of 20% by mass of EDTA (ethylenediaminetetraacetic acid) was added to the reaction vessel, and then 1 mol/L of an aqueous solution of sodium hydroxide was added to control the pH of the raw material dispersion to 9.0. Thereafter, while adjusting the pH to 9.0 every 5° C., the temperature was raised to 85° C., at a heating rate of 1° C./min, and held at 85° C.

Thereafter, the mixture was cooled at a temperature lowering rate of 10° C./min at a time point when the shape factor measured using a particle size meter (manufactured by Mulban Co., Ltd., FPIA-3000) became 0.970, thereby obtained a toner base particle dispersion (1).

Thereafter, the solid content obtained by filtering the toner base particle dispersion (1) was sufficiently washed with ion-exchanged water. Then, the solid content was dried at 40° C. to obtain toner base particles (1). The average particle diameter on a volume basis of the obtained toner base particles (1) was 6.0 μm, and the average circularity measured using a particle size meter (manufactured by Malvern Co., Ltd., FPIA-3000) was 0.972.

1-5-2. Preparation of Toner Base Particles (2)

Toner base particles (2) were obtained in the same manner as in the preparation of toner base particles (1), except that pigment particle dispersion (2) was used instead of pigment particle dispersion (1). The average particle diameter on a volume basis of the obtained toner base particles (3) was 6.0 μm, and the average circularity measured using a particle size distribution measuring device (manufactured by Malvern Co., Ltd., FPIA-3000) was 0.972.

1-5-3. Preparation of Toner Base Particles (3)

Amorphous polyester resin particle dispersion (a1): 1440 parts by mass

Release agent particle dispersion (W1): 200 parts by mass

Pigment particle dispersion (1): 335 parts by mass

Anionic surfactant: 40 parts by mass

Ion exchange water: 1500 parts by mass

A 4 liter reaction vessel equipped with a thermometer, a pH meter and a stirrer was charged with the above material, and a 1.0% by mass aqueous nitric acid solution was added under a temperature of 25° C. to adjust the pH to 3.0. Thereafter, 100 parts by mass of an aqueous solution of 2.0% by mass aluminum sulfate (flocculant) was added over 30 minutes while being dispersed at 3000 rpm in a homogenizer (manufactured by IKA Corporation. Ultratalax T50). After completion of the dropping, the mixture was stirred for 10 minutes, and the raw material and the flocculant were thoroughly mixed.

Thereafter, a stirrer and a mantle heater are installed in the reaction vessel, while adjusting the number of revolutions of the stirrer so that the slurry is sufficiently stirred, the slurry was heated at a temperature rise rate of 0.2° C./min up to a temperature of 40° C., and a temperature rise rate of 0.05° C./min after exceeding 40° C., and particle size was measured every 10 minutes by a particle size distribution measuring device (manufactured by Beckman Coulter Co. Ltd., Coulter Multisizer 3 (aperture diameter 100 μm)). The temperature was held at a point where the average particle diameter on a volume basis became 5.9 μm, and a mixed liquid of the following materials prepared in advance was charged over a period of 20 minutes.

Amorphous polyester resin particle dispersion (a1): 160 parts by mass

Anionic surfactant: 15 parts by mass

Both of the anionic surfactants charged 2 times described above are Dowfax 2A1 (20% aqueous solution) manufactured by Dow Chemical Co., Ltd.

Then, after holding at 50° C. for 30 minutes, 8 parts of a 20% solution of EDTA (ethylenediaminetetraacetic acid) was added to the reaction vessel, and then 1 mol/L of an aqueous sodium hydroxide solution was added thereto to control the pH of the raw material dispersion to 9.0. Thereafter, while adjusting the pH to 9.0 every 5° C. the temperature was raised to 85° C., at a heating rate 1° C./min, and held at 85° C.

Thereafter, the mixture was cooled at a temperature lowering rate of 10° C./min at a tune point when the shape factor measured using a particle size meter (manufactured by Mulban Co., Ltd., FPIA-3000) became 0.970, thereby obtained a toner base particle dispersion (3).

Thereafter, the solid content obtained by filtering the toner base particle dispersion (3) was sufficiently washed with ion-exchanged water. Then, the solid content was dried at 40° C. to obtain toner base particles (3). The average particle diameter on a volume basis of the obtained toner base particles (3) was 6.0 μm, and the average circularity measured using a particle size meter (manufactured by Malvern Co., Ltd., FPIA-3000) was 0.972.

1-54. Preparation of Toner Base Particles (4)

Styrene-acrylic resin particle dispersion (b1): 1280 parts by mass

Crystalline polyester resin particle dispersion (c1): 160 parts by mass

Release agent particle dispersion (W1): 200 parts by mass

Pigment particle dispersion (1): 335 parts by mass

Anionic surfactant: 40 parts by mass

Ion exchange water: 1500 parts by mass

A 4 liter reaction vessel equipped with a thermometer, a pH meter and a stirrer was charged with the above material, and a 1.0% by mass aqueous nitric acid solution was added under a temperature of 25° C. to adjust the pH to 3.0. Thereafter, 100 parts by mass of an aqueous solution of 2.0% by mass aluminum sulfate (flocculant) was added over 30 minutes while being dispersed at 3.000 rpm in a homogenizer (manufactured by IKA Corporation. Ultratalax T50). After completion of the dropping, the mixture was stirred for 10 minutes, and the raw material and the flocculant were thoroughly mixed.

Thereafter, a stirrer and a mantle heater are installed in the reaction vessel, while adjusting the number of revolutions of the stirrer so that the slurry is sufficiently stirred, a temperature rise rate of 0.2° C./min up to a temperature of 40° C., and a temperature the slurry was heated at a temperature rise rate of 0.2° C./min up to a temperature of 40° C., and a temperature rise rate of 0.05° C./min after exceeding 40° C., and particle size was measured every 10 minutes by a particle size distribution measuring device (manufactured by Beckman Coulter Co., Ltd., Coulter Multisizer 3 (aperture diameter 100 μm)). The temperature was held at a point where the average particle diameter on a volume basis became 5.9 μm, and a mixed liquid of the following materials prepared in advance was charged over a period of 20 minutes.

Amorphous polyester resin particle dispersion (a1): 160 parts by mass

Anionic surfactant: 15 parts by mass

Both of the anionic surfactants charged 2 times described above are Dowfax 2A1 (20% aqueous solution) manufactured by Dow Chemical Co., Ltd.

Then, after holding at 50° C. for 30 minutes, 8 parts by mass of an aqueous solution of 20% by mass of EDTA (ethylenediaminetetraacetic acid) was added to the reaction vessel, and then 1 mol/L of an aqueous solution of sodium hydroxide was added to control the pH of the raw material dispersion to 9.0. Thereafter, while adjusting the pH to 9.0 every 5° C. the temperature was raised to 85° C., at a heating rate 1° C./min, and held at 85° C.

Thereafter, the mixture was cooled at a temperature lowering rate of 10° C./min at a time point when the shape factor measured using a particle size meter (manufactured by Mulban Co., Ltd., FPIA-3000) became 0.970, thereby obtained a toner base particle dispersion (4).

Thereafter, the solid content obtained by filtering the toner base particle dispersion (4) was sufficiently washed with ion-exchanged water. Then, the solid content was dried at 40° C. to obtain toner base particles (4). The average particle diameter on a volume basis of the obtained toner base particles (4) was 6.0 μm, and the average circularity measured using a particle size meter (manufactured by Malvern Co., Ltd., FPIA-3000) was 0.972.

1-5-6. Preparation of Toner Base Particles (6) to Toner Base Particles (17)

Toner base particles (6) to toner base particles (17) were obtained in the same manner as in the preparation of the toner base particle dispersion (1), except that the pigment particle dispersion (3) to pigment particle dispersion (15) were each used instead of the pigment particle dispersion (1). The average particle diameter on a volume basis of the obtained toner base particles (6) to toner base particles (17) were each 6.0 μm, and the average circularity measured using a particle size meter (manufactured by Malvern Co., Ltd., FPIA-3000) were each 0.972.

1-6. Preparation of the Carrier 1-6-1. Preparation of Core Particles

MnO: 35.0 mol %

MgO: 14.5 mol %

$Fe_2O_3$: 50.0 mol %

SrO: 0.5 mol %

Each raw material was weighed so as to have the above amount ratio, mixed with water, and then pulverized by a wet media mill for 5 hours to obtain a slurry.

The resulting slurry was dried by spray dryer to obtain true spherical particles. After the particle size adjustment, the particles were heated for 2 hours at 950° C., and subjected to calcination in a rotary kiln. After grinding for 1 hours in a dry ball mill using stainless beads having a diameter of 0.3 cm, polyvinyl alcohol (PVA) as a binder of 0.8% by mass based on the solid content was added, and further, water and a polycarboxylic acid-based dispersant were added, and the mixture was ground using zirconia beads having a diameter of 0.5 cm for 30 hours. The obtained powder was granulated by a spray dryer, dried, and was subjected to main firing by holding for 15 hours in an electric furnace at a temperature of 1050° C.

The powder after firing was crushed and further classified to adjust the particle size, and then low-magnetic-force product was fractionated by magnetic force sorting to obtain core particles. The volume average particle diameter of the core particles was 30 μm.

The volume average particle size of the core material particles is a value obtained by measuring by a wet method, using a laser diffractive particle size distribution measuring apparatus (manufactured by Nippon Laser Co., Ltd., HELOS). Specifically, first, select the optical system of the focal position 200 mm, and set the measurement time to 5 seconds. Then, the core particles for measurement were added to an aqueous solution of 0.2% by mass sodium dodecyl sulfate, and dispersed for 3 minutes using an ultrasonic cleaner (manufactured by asone Co., Ltd., US-1) to prepare a sample dispersion for measurement, which was fed into the laser diffraction type particle size distribution measuring device by several drops, and measurement was started when the sample concentration gauge reached the measurable region. Of the obtained particle size distribution was based on the particle size range (channel), the cumulative distribution was prepared from the small diameter side, and the volume average particle diameter was calculated based on the cumulative distribution.

1-7-2. Preparation of Coating Resin

In an aqueous solution of 0.3 mass/sodium benzenesulfonate, cyclohexyl methactylate and methyl methacrylate in an amount having a mass ratio (copolymerization ratio) of 70:30 were added, and potassium persulfate in an amount of corresponding to 0.5% by mass of the total amount of monomers was added to perform emulsion polymerization, and the mixture was dried by spray drying to prepare a coating resin. The weight average molecular weight of the coating resin was 500,000.

1-7-3. Fabrication of the Carrier

A high-speed stirring mixer with a horizontal stirring blade was charged with 100 parts by mass of the prepared core particles and 4.5 parts by mass of the prepared coating resin, and mixed and stirred at 22° C. for 15 minutes under the condition that the peripheral speed of the horizontal rotating blade was 8 m/sec, and then mixed and stirred at 120° C. for 50 minutes to coat the surface of the core particles with the coating resin by the action of a mechanical impact force (mechanochemical method), and then cooled to room temperature to produce a carrier.

1-7. Preparation of Toner for Electrostatic Charge Image Development 1-7-1. Preparation of Toner (1)

To 100 parts by mass of the toner base particles (1), 1.0 parts by mass of alumina and 1.5 parts by mass of silica (number average particle diameter: 20 nm) were added and mixed in a Henschel mixer for 20 minutes. Thereafter, the toner was mixed with the above carrier so that the toner concentration became 9% by mass, and mixed using a V-type mixer (manufactured by Tokushu Kogyo Seisakusho Co., Ltd.) for 30 minutes at 25° C., thereby obtained toner (I) as a toner for developing an electrostatic charge image (developer).

The number average particle size of the silica particles was obtained using a scanning electron microscope (SEM) (manufactured by Nippon Electronics Co., Ltd., JEM-7401F). SEM photograph enlarged at 50000 times is taken by a scanner, the image processing analyzer (Nileco Co., Ltd., LUZEX AP), and the silica particles of the SEM photographic image was subjected to a 2 valorization process and the horizontal Ferre diameter for 100 silica particles was calculated to obtain the number average particle size of the silica particles.

1-7-2. Preparation of Toner (2) to Toner (16)

Toner (2) to toner (16) were obtained in the same manner as in the preparation of toner (1), except that toner base particles (2) to toner base particles (16) were each used instead of toner base particles (1).

1-7-3. Preparation of Toner (17)

To 100 parts by mass of the toner base particles (1), 1.0 parts by mass of silica (number average particle diameter: 60 nm) and 1.5 parts by mass of silica (number average particle diameter: 20 nm) were added and mixed by a Henschel mixer for 20 minutes. Thereafter, the toner was mixed with the carrier so that the toner concentration became 9% by mass, and mixed using a V-type mixer (manufactured by Tokushu Kogyo Seisakusho Co., Ltd.) for 30 minutes at 25° C., thereby producing a toner (17) as a toner for developing an electrostatic charge image (developer).

1-7-4. Preparation of Toner (18)

Toner (18) was obtained in the same manner as in the preparation of toner (1), except that toner base particles (17) was used instead of toner base particles (1).

Table 3 and Table 4 show the toner base particles used in the preparation of the toner (1) to the toner (18), the type of the pigment and the amount thereof (the amount of each pigment (parts by mass when the mass of the toner base particles is set to 100 parts by mass)), the type of the resin, and the type and the use of alumina as an external additive.

TABLE 3

| Toner | Base Particle | Dispersion | Toner Base Particle | | | | | | | | | | | |
|---|---|---|---|---|---|---|---|---|---|---|---|---|---|---|
| | | | Pigment | | | | | | | | | | | |
| | | | Organic Pigment | | | | | | | | | Binder Resin | | |
| | | | P1-1 (400~460 nm) | | P1-2 (460~530 nm) | | P1-3 (530-600 nm) | | P2 (600~700 nm) | | CB | Crystalline Resin | Amorphous Resin | External Additive |
| No. | No.. | No. | Name | Parts | Name | Parts | Name | Parts | Name | Parts | Name | Name | Name | Alumina |
| (1) | (1) | (1) | PY 155 | 2.5 | PBr 25 | 4 | PV 23 | 1 | PB 15:3 | 2.5 | — | c1 | a1 | + |
| (2) | (2) | (2) | PY 155 | 2.5 | PBr 25 | 3.2 | PV 23 | 1 | PB 15:3 | 2.5 | 0.8 | c1 | a1 | + |
| (3) | (3) | (1) | PY 155 | 2.5 | PBr 25 | 4 | PV 23 | 1 | PB 15:3 | 2.5 | — | — | a1 | + |
| (4) | (4) | (1) | PY 155 | 2.5 | PBr 25 | 4 | PV 23 | 1 | PB 15:3 | 2.5 | — | c1 | a1 + b1 | + |
| (5) | (5) | (3) | — | — | PBr 25 | 6 | — | — | PB 15:3 | 4 | — | c1 | a1 | + |
| (6) | (6) | (4) | — | — | PBr 25 | 5.2 | — | — | PB 15:3 | 4 | 0.8 | c1 | a1 | + |
| (7) | (7) | (5) | PY 155 | 3.5 | — | — | PV 23 | 2.5 | PB 15:3 | 4 | — | c1 | a1 | + |
| (8) | (8) | (6) | — | — | — | — | PV 23 | 4 | PB 15:3 | 6 | — | c1 | a1 | + |
| (9) | (9) | (7) | — | — | — | — | PV 23 | 3.2 | PB 15:3 | 6 | 0.8 | c1 | a1 | + |
| (10) | (10) | (8) | PY 155 | 2.5 | PBr 25 | 5 | PV 23 | 1 | PB 15:3 | 1.5 | — | c1 | a1 | + |
| (11) | (11) | (9) | PY 155 | 2.5 | PBr 25 | 2.5 | PV 23 | 1 | PB 15:3 | 4 | — | c1 | a1 | + |
| (12) | (12) | (10) | PY 180 | 2.5 | PBr 25 | 4 | PV 23 | 1 | PB 15:3 | 2.5 | — | c1 | a1 | + |
| (13) | (13) | (11) | PY 180 | 2.5 | PBr 23 | 4 | PV 23 | 1 | PB 15:3 | 2.5 | — | c1 | a1 | + |

TABLE 4

| Toner | Base Particle | Dispersion | Toner Base Particle | | | | | | | | | | | |
|---|---|---|---|---|---|---|---|---|---|---|---|---|---|---|
| | | | Pigment | | | | | | | | | | | |
| | | | Organic Pigment | | | | | | | | | Binder Resin | | |
| | | | P1-1 (400~460 nm) | | P1-2 (460~530 nm) | | P1-3 (530~600 nm) | | P2 (600~700 nm) | | CB | Crystalline Resin | Amorphous Resin | External Additive |
| No.. | No.. | No. | Name | Parts | Name | Parts | Name | Parts | Name | Parts | Parts | Name | Name | Alumina |
| (14) | (14) | (12) | PY 155 | 2.5 | PBr 25 | 6.5 | PV 23 | 1 | — | — | — | c1 | a1 | + |
| (15) | (15) | (13) | — | — | — | — | — | — | PB 15.3 | 9.2 | 0.8 | c1 | a1 | + |
| (16) | (16) | (14) | — | — | — | — | — | — | — | — | 10 | c1 | a1 | + |
| (17) | (1) | (1) | PY 155 | 2.5 | PBr 25 | 4 | PV 23 | 1 | PB 15:3 | 2.5 | — | c1 | a1 | – |
| (18) | (17) | (15) | PY 155 | 2.5 | PBr 25 | 3.2 | PV 23 | 1.0 | PB 15:3 | 3.3 | — | c1 | a1 | + |

2. Evaluation

For the image forming in the evaluation of the toner (1) to the toner (19), an evaluation device modified so that the surface temperature of the fixing heat roller of the image forming device (Konica Minolta Corporation, bizhub PRESS C1100) can be changed in the range of 80 to 180° C. was used. Each of the prepared toner and developer were filled into the toner cartridge and the developer, respectively, in this evaluation apparatus to be an image forming apparatus for evaluation.

2-1. Reflectance (Infrared Transmittance)

A solid image (2 cm×2 cm) with a toner adhered amount of 4.5 g/m$^2$ was formed on an A4 size OK topcoat+(127.9 g/m$^2$) (manufactured by Oji Paper Co., Ltd.). A spectrophotometer (manufactured by Hitachi High-Tech Science Corporation. U 4100) was used to measure the reflectance spectra of the images with filter papers as a reference, and the reflectance in the near-infrared region around the wavelength of 800-1000 nm was measured. Reflectivity of each toner was evaluated by the following criteria from the obtained reflectance in the near infrared region. It can be judged that the higher the reflectance, less light absorption in the near-infrared region, and the higher the efficiency of near-infrared radiation transmittance.

A: Reflectance in the near infrared region is 90% or more.

A: Reflectance in the near infrared region is 80% or more and less than 90%.

C: Reflectance in the near infrared region is less than 80%.

2-2. Image Density (Concealability)

A solid image (2 cm×2 cm) using an adhered amount of toner as a 4.5 g/m$^2$ was formed on an A4 size OK topcoat+ (127.9 g/m$^2$) (manufactured by Oji Paper Co., Ltd.). The reflectance density of the solid portion of the image was measured using a reflectance densitometer (manufactured by Macbeth Co., Ltd., RD-918). From the obtained reflection density (image density), the image density of each toner was evaluated on the basis of the following criteria.

AA: Image density is greater than or equal to 1.50

A: The image density is 1.30 or more and less than 1.50

C: Image density is less than 1.30

2-3. Charging Property

Band-like solid images with a printing ratio of 5% were formed on the high-quality paper (65 g per m2) of the A4 plate at high-temperature and high-humidity (HH) (temperature 30° C., humidity 85% RH) ambient conditions and low-temperature and low-humidity (LL) (temperature 10° C., humidity 20% RH) ambient conditions, respectively. The amount of charge of the toner after printing 0.1 million sheets under each environment was measured, and by calculating the difference between the amount of charge under the LL environment and the amount of charge under the HH environment, the environmental difference Δ of the withstand voltage was measured. The charge amount is a value obtained by sampling a two components developer in a developer and measuring it using a blow-off charge amount measuring device (TB-200, manufactured by Toshiba Chemical Co. Ltd.). From the obtained environmental difference Δ of the withstand voltage, the charging property of each toner was evaluated by the following criteria. It can be judged that the smaller Δ, the better the charging property of the toner.

AA: The environmental difference Δ of the charge amount of the toner is less than 8 μC/g.

A: The environmental difference Δ of the charge amount of the toner is 8 μC/g or more and less than 12 μC/g.

B: The environmental difference Δ of the charge amount of the toner is 12 μC/g or more and less than 15 μC/g.

C: The environmental difference Δ of the charge amount of the toner is 15 μC/g or more.

2-4. Fixability

In normal temperature and normal humidity (NN) (temperature 20° C., humidity 50% RH) ambient conditions, a solid image with a toner adhering amount of 10 g/m$^2$ was formed on an A4 size OK topcoat+(127.9 g/m$^2$) (manufactured by Oji Paper Co., Ltd.). At this time, the temperature of the pressure roller was set 20° C. lower than that of the fixing roller, and the surface temperature of the fixing roller was changed up to 140° C. while changing so as to increase in increments of 5° C. from 80° C. From the temperature at which the image began to settle, the fixability (low-temperature fixability) of each toner was evaluated according to the following criteria.

AA The temperature at which the image begins to settle is below 120° C.

A: The temperature at which the image begins to fix is 120° C. or more and less than 150° C.

C: The temperature at which the image begins to settle is higher than 150° C.

Table 5 shows the evaluation results of toner (1) to toner (18).

TABLE 5

| | Toner No. | Evaluation | | | |
|---|---|---|---|---|---|
| | | Reflectance (Infrared Transmittance) | Image Density (Concealability) | Charging Property | Fixability |
| Working Example | (1) | AA | AA | AA | AA |
| Working Example | (2) | A | AA | A | AA |
| Working Example | (3) | AA | AA | AA | A |
| Working Example | (4) | AA | AA | AA | A |
| Working Example | (5) | AA | A | AA | AA |
| Working Example | (6) | A | AA | A | AA |
| Working Example | (7) | AA | A | AA | AA |
| Working Example | (8) | AA | A | AA | AA |
| Working Example | (9) | A | AA | A | AA |
| Working Example | (10) | AA | A | AA | AA |

TABLE 5-continued

| | Toner No. | Evaluation | | | |
|---|---|---|---|---|---|
| | | Reflectance (Infrared Transmittance) | Image Density (Concealability) | Charging Property | Fixability |
| Working Example | (11) | AA | AA | A | AA |
| Working Example | (12) | A | A | AA | AA |
| Working Example | (13) | A | AA | AA | AA |
| Comparative Example | (14) | A | C | AA | AA |
| Comparative Example | (15) | A | C | A | AA |
| Comparative Example | (16) | C | AA | C | A |
| Comparative Example | (17) | A | A | C | AA |
| Working Example | (18) | AA | AA | AA | AA |

As is apparent from Table 5, toner (1) to toner (13) and toner (18) containing a toner base particle containing a binder resin and at least two kinds of organic pigments containing the pigment P1 and the pigment P2, and an external additive containing alumina adhering to the surface of the toner base particles were smaller in the amount of absorption of electromagnetic waves in the near infrared region and superior in the charge stability than toner (16) in which the concealability was increased by the carbon black.

In addition, toner (1) to toner (13) and toner (18) containing the pigment P1 which becomes larger than the absorption maximum wavelength λmax (nm) of 400 nm and less than 600 nm when dispersed in methyl ethyl ketone and the pigment P2 which has an absorption maximum wavelength λmax (am) of 600 nm or more and 700 nm or less when dispersed in methyl ethyl ketone were superior to toner (14) and toner (15) winch do not contain any of these.

Further, toner (1) to toner (13) and toner (18) containing a binder resin, a toner base particle containing at least two kinds of organic pigments containing pigment P1 and pigment P2, and an external additive containing alumina adhering to the surface of the toner base particles described above were superior in stability of charging than toner (17) containing no alumina in an external additive.

Toner (2), toner (6), and toner (9) containing the pigment P1 and the pigment P2 and the carbon black of less than 1% by mass based on the total mass of the toner had a tendency to increase the hiding property of the image as compared with toner (1), toner (5), and toner (8) containing no carbon black, respectively, but the amount of absorption of the electromagnetic wave in the near-infrared region was slightly reduced, and the stability of the charging was also slightly lowered. However, when the content of carbon black was less than 1% by mass, any evaluation was not remarkably deteriorated.

Toner (1) to toner (4) and toner (18) containing four kinds of pigments of pigment P1-1, pigment P1-2, pigment P1-3 and pigment P2 had increased concealability of images compared with toner (5), toner (7) and toner (8) having less kinds of pigment.

In toner (1) and toner (18) in which the amounts of the pigment P2 is 18% by mass or more and 69% by mass or less based on the total mass of the pigment, the concealability of the image was increased as compared with toner (10) in which the content of the pigment P2 is less than 18% by mass.

In toner (1) and toner (18) in which the content of the pigment P1-2 is 31% by mass or more and 69% by mass or less based on the total mass of the pigment, the stability of charging was increased as compared with toner (11) in which the content of the pigment P1-2 is less than 31% by mass.

INDUSTRIAL APPLICABILITY

According to the present invention, them is provided a toner containing two or more kinds of pigments, which can form an image excellent in various characteristics required at the time of image formation and also excellent in various characteristics required for an image.

Although embodiments of the present invention have been described and illustrated in detail, the disclosed embodiments are made for purposes of illustration and example only and not limitation. The scope of the present invention should be interpreted by terms of the appended claims.

What is claimed is:

1. A toner for electrostatic charge image development comprising:

a toner base particle comprising a binder resin and at least two kinds of organic pigments; and alumina particles as an external additive; wherein, the at least two kinds of organic pigments comprises:

a pigment P1 having an absorption maximum wavelength Amax (nm) of greater than 400 nm and less than 600 nm when dispersed in methyl ethyl ketone; and a pigment P2 having an absorption maximum wavelength A max (nm) of 600 nm or more and 700 nm or less when dispersed in methyl ethyl ketone, wherein the toner optionally comprises carbon black in an amount of more than 0% and 1% by mass or less based on the total mass obtained by summing up the toner base particles and the external additive.

2. The toner for developing an electrostatic charge image according to claim 1, wherein the pigment P2 comprises at least one pigment selected from the group consisting of C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 15:5, C.I. Pigment Blue 15:6 and C.I. Pigment Blue 16.

3. The toner for developing an electrostatic charge image according to claim 1, wherein the amount of the pigment P2 is 18% by mass or more and 69% by mass or less based on the total mass of the pigments.

4. The toner for electrostatic charge image development according to claim 1, wherein the pigment P1 comprises at least one pigment selected from the group consisting of C.I. Pigment Yellow 74, C.I. Pigment Yellow 120, C.I. Pigment Yellow 139, C.I. Pigment Yellow 151, C.I. Pigment Yellow 155, C.I. Pigment Yellow 180, C.I. Pigment Yellow 181, C.I. Pigment Yellow 185, C.I. Pigment Yellow 213, C.I. Pigment Green 7, C.I. Pigment Green 36, C.I. Pigment Green 254, C.I. Pigment Brown 23, C.I. Pigment Brown 25, C.I. Pigment Brown 41, C.I. Pigment Red 38, C.I. Pigment Orange 34, C.I. Pigment Orange 36, C.I. Pigment Orange 38, C.I. Pigment Orange 43, C.I. Pigment Orange 62, C.I. Pigment Orange 68, C.I. Pigment Orange 70, C.I. Pigment Orange 72, C.I. Pigment Orange 74, C.I. Pigment Red 31, C.I. Pigment Red 48:4, C.I. Pigment Red 57:1, C.I. Pigment Red 122, C.I. Pigment Red 146, C.I. Pigment Red 147, C.I. Pigment Red 150, C.I. Pigment Red 184, C.I. Pigment Red 238, C.I. Pigment Red 242, C.I. Pigment Red 254, C.I. Pigment Red 269, C.I. Pigment Violet 19, C.I. Pigment Violet 23, and C.I. Pigment Violet 32.

5. The toner for electrostatic charge image development according to claim 1, wherein the pigment P1 comprises a pigment P1-2 having an absorption maximum wavelength λ max (nm) of 460 nm or more and 530 nm or less when dispersed in methyl ethyl ketone.

6. The toner for electrostatic charge image development according to claim 5, wherein the pigment P1-2 comprises at least one pigment selected from the group consisting of C.I. Pigment Brown 23, C.I. Pigment Brown 25, C.I. Pigment Brown 41, and C.I. Pigment Red 38.

7. The toner for developing an electrostatic charge image according to claim 5, wherein the amount of the pigment P1-2 is 31% by mass or more and 69% by mass or less based on the total mass of the pigments.

8. The toner for developing an electrostatic charge image according to claim 1, wherein the toner base particle comprises the carbon black in the amount of more than 0% and 1% by mass or less based on the total mass obtained by summing up the toner base particles and the external additive.

9. The toner for developing an electrostatic charge image according to claim 1, wherein the binder resin comprises a crystalline polyester.

10. An image forming method comprising;

adhering the toner for developing an electrostatic charge image according to claim 1 to a recording medium; and fixing the adhered toner for developing an electrostatic charge image to the recording medium.

* * * * *